United States Patent [19]

Crowell et al.

[11] 4,441,270

[45] Apr. 10, 1984

[54] STAGGERED FLIP-PAGE DISPLAY FOLDER

[75] Inventors: Christopher S. Crowell, Lyme; Warren Dennison, East Lyme, both of Conn.

[73] Assignee: Structural Graphics, Inc., Essex, Conn.

[21] Appl. No.: 407,103

[22] Filed: Aug. 11, 1982

[51] Int. Cl.[3] ..... G09F 19/00

[52] U.S. Cl. ..... 40/534; 40/530; 40/531; 46/36; 283/1 R; 283/56

[58] Field of Search ..... 40/359, 389, 391, 124, 40/124.1, 124.4, 534, 533, 532, 531, 530; 46/35, 36, 37; 283/903, 1 R, 56; 434/365, 367, 368, 369, 414, 428, 430, 433

[56] References Cited

U.S. PATENT DOCUMENTS

| | | | |
|---|---|---|---|
| 800,701 | 3/1905 | White | 40/534 |
| 930,290 | 8/1909 | Hohn | 40/534 |
| 1,016,789 | 2/1912 | Smith | 40/359 |
| 1,603,362 | 10/1926 | Stewart | 434/365 |
| 2,140,926 | 12/1938 | Sheppard | 40/391 |
| 2,253,858 | 8/1941 | Lucas et al. | 40/531 |
| 3,191,328 | 6/1965 | Lohnes | 40/124.1 |

FOREIGN PATENT DOCUMENTS

| | | | |
|---|---|---|---|
| 416328 | 11/1946 | Italy | 40/530 |
| 437207 | 11/1967 | Switzerland | 40/531 |

*Primary Examiner*—Gene Mancene
*Assistant Examiner*—James Hakomaki
*Attorney, Agent, or Firm*—Mattern, Ware, Stoltz & Fressola

[57] ABSTRACT

A multi-page folder having a staggered array of interleaved pages successively flipped by manual actuation of a drawstrip. The folder includes a back cover panel bounded by a right fold line joining it to an overlying contiguous base panel, a central slot formed near the fold line joining the back panel and the base panel, a distal segmented tab extending from the base panel away from the right fold line, a plurality of substantially parallel fold lines traversing and subdividing the tab into plural segments, an elongated drawstrip joined to the last tab segment most remote from the right fold line and extending between the back cover panel and the base panel through the central slot longitudinally movable from a retracted position substantially flattening the segmented tab to an extended position protruding through the central slot beyond the right fold line and curling the segmented tab under the base panel toward the slot. The individual separate pages are respectively secured to individual segments of the segmented tab and interleaved in staggered array protruding alternately toward opposite sides of the elongated drawstrip and the segmented tab, whereby progressive movement of the drawstrip from its retracted position towards its extended position causes progressive curling movement of the segmented tab, successively flipping over the individual staggered interleaved pages, while at all times displaying to view at least one full page and a substantial area of an underlying staggered page, thereby changing only part of the indicia displayed during each successive stage of the page-flipping operation.

6 Claims, 9 Drawing Figures

STAGGERED FLIP-PAGE DISPLAY FOLDER

This invention relates to advertising, instructional and promotional multi-page folders, and particularly to such folders incorporating a flip-page mechanism providing a draw strip connected to all successive pages of the folder, to turn them, one after another, as the draw strip is pulled successively further from a retracted position toward an extended position.

Conventional display folders showing text and pictorial illustrations on both sides of a number of successive pages have long been used by educational, marketing and sales personnel to familiarize students, customers and prospects with the programs, products and services offered. Some of these multi-page display folders have been provided with mechanisms causing successive pages to flip over in response to movement of a movable part of the folder such as a curling draw strip, which may be actuated manually by the salesman or by the reader.

A disadvantage of these prior and conventional flip-page folders is the abrupt suddeness with which each page is flipped ovver by such mechanisms, tending to distract the reader and break his concentration at a time when continuity of attention and delivery of a continuous message are considered most important.

The flip-page folders of the present invention overcome this disadvantage by maintaining continuity of the message delivered, and minimizing the abruptness of the flip-change of information displayed, as each page is turned successively by such mechanism. This continuity of information display is achieved by a transversely staggered array of successive pages, by which they are displaced on opposite sides of the central axis of the draw strip, exposing a substantial area of the next succeeding page together with the preceding page for simultaneous viewing by the observer. When each page is flipped, the full area of the next page is displayed together with the reverse side of the flipped page and a substantial area of each underlying page. Thus approximately two full pages and two half pages of information are displayed to the viewer simultaneously: two facing pages, plus a substantial portion of two underlying pages.

Accordingly, a principal object of the present invention is to provide a flip-page folder affording manually actuated page-flipping operation, while avoiding the abruptness of the information-change characteristic of conventional flip-page folders.

A further object of the present invention is to provide flip-page folders of this character affording information continuity to the viewer by displaying the full side of a page together with a substantial portion of the next underlying page simultaneously by virture of transverse staggered successive displacement of the pages in the folder.

Another object of the present invention is to provide such flip-page folders affording continuity of information display while also providing manual page-flipping actuation by the operation of a simple draw strip mechanism actuated by the user or an operator from the side of the information display zone without any necessity for reaching across it to turn pages manually.

Still another object of the invention is to provide such flip-page folders avoiding abrupt changes of all information displayed by exposing substantial portions of a transversely staggered underlying page behind each page displayed in succession.

Other objects of the invention will in part be obvious and will in part appear hereinafter.

The invention accordingly comprises the features of construction, combinations of elements, and arrangement of parts which will be exemplified in the constructions hereinafter set forth, and the scope of the invention will be indicated in the claims.

For a fuller understanding of the nature and objects of the invention, reference should be had to the following detailed description taken in connection with the accompanying drawings.

THE BEST MODE FOR CARRYING OUT THE INVENTION

Figure 1:
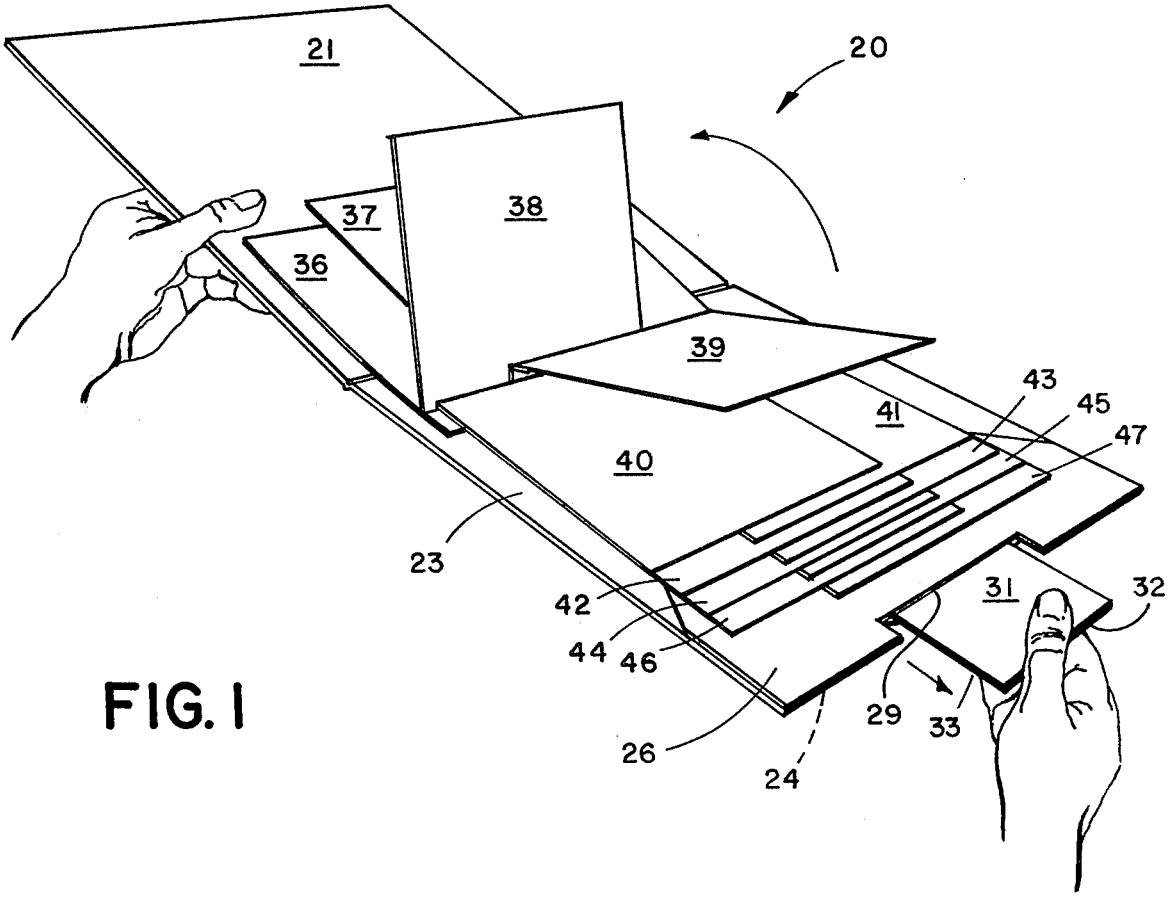
FIG. 1 is a perspective view of a staggered page flip-page folder of the present invention showing two transversely-offset, staggered pages already turned, with the next two staggered pages shown in the process of being flipped, making their facing sides visible for display to the observer, whose hands are shown holding the folder and pulling the draw strip to flip the folder pages.
Figure 8:
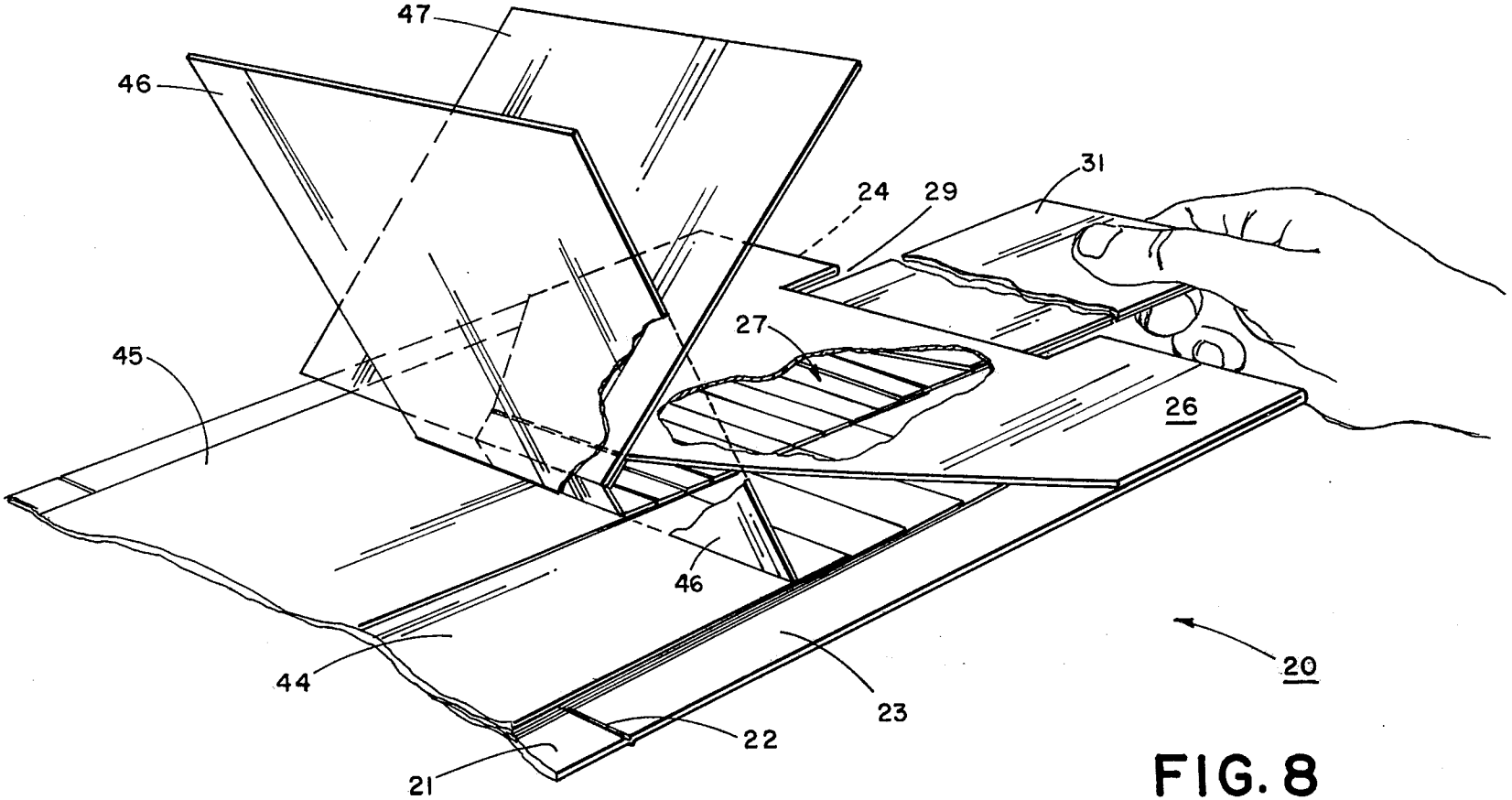
FIG. 8 is a fragmentary perspective view, partially cut away, showing the same flip-page folder with its draw strip almost fully extended, with the last two staggered pages in the process of being flipped and all of the preceding pages already flipped to their open position.

The flip-page folder 20 shown in perspective views of FIGS. 1 and 8 incorporates a front cover 21 joined along a score line 22 to a back cover 23 whose opposite edge, remote from score line 22, is formed as a second score line 24 hingedly joining back cover 23 to a base panel 26, which is thereby adapted to be folded into juxtaposition atop back panel 23, as indicated in FIGS.

Figure 2:
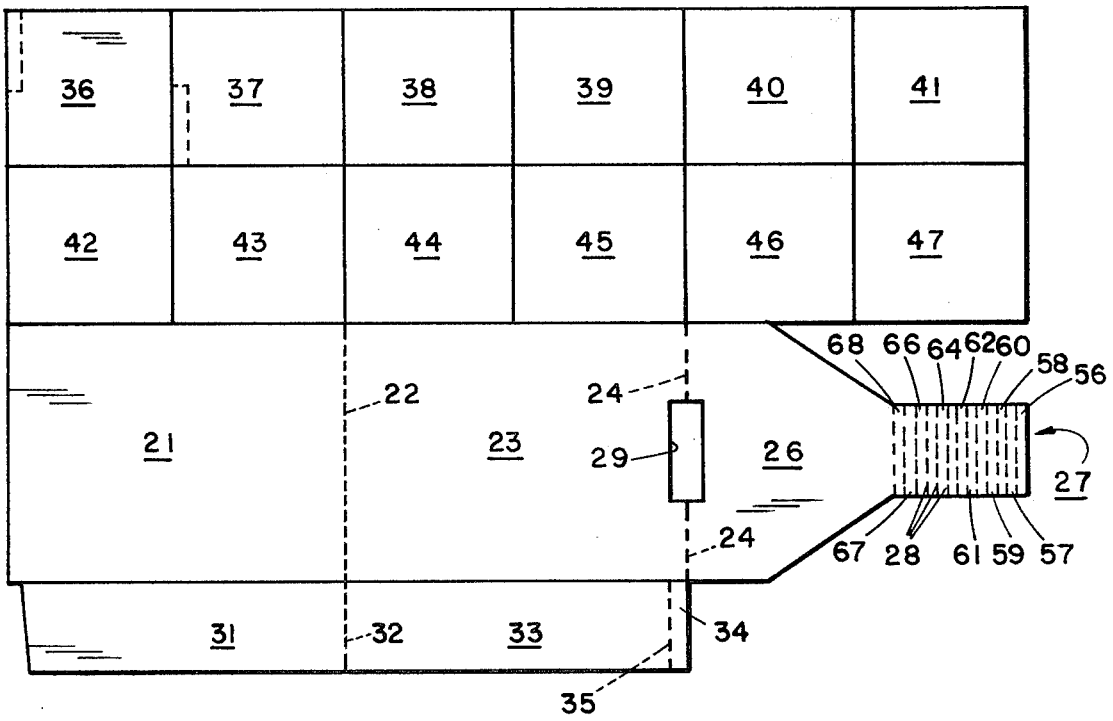
FIG. 2 is a top plan view of a flat blank, scored to be respectively folded and severed along fold lines and score lines, for the fabrication of the flip-page folder shown in FIG. 1.

3 and 5. The opposite end of base panel 26, remote from score line 24 comprises an extending tab 27 having a plurality of parallel score lines 28, thus forming a multiply-segmented page support panel 25 with a plurality of twelve narrow rectangular segments 56–58 hingedly joined to each other by parallel score lines 28, as shown in FIG. 2. A central portion of score line 24 hingedly joining base panel 26 to back cover 23 is sheared away to form an acutating slot 29, preferably having a vertical height along the central part of score line 24 slightly exceeding the vertical height of the segmented page support panel 27–28.

Severable from the lower edge of cover panels 21 and 23 is an elongated draw strip formed of a top draw strip panel 31 hingedly joined by a score line 32 to a bottom draw strip panel 33 forming at its opposite end, remote from score line 32, a glue zone 34, joined to panel 33 by a foldably scored hinge-line 35. Scored for severed removability from the cover panels 21 and 23 are a plurality of twelve separate pages 36 through 47 dimensioned to be die cut in substantially identical sizes ready to be mounted in the flip-page folder of the present invention in the staggered manner hereinafter described.

Figure 3:
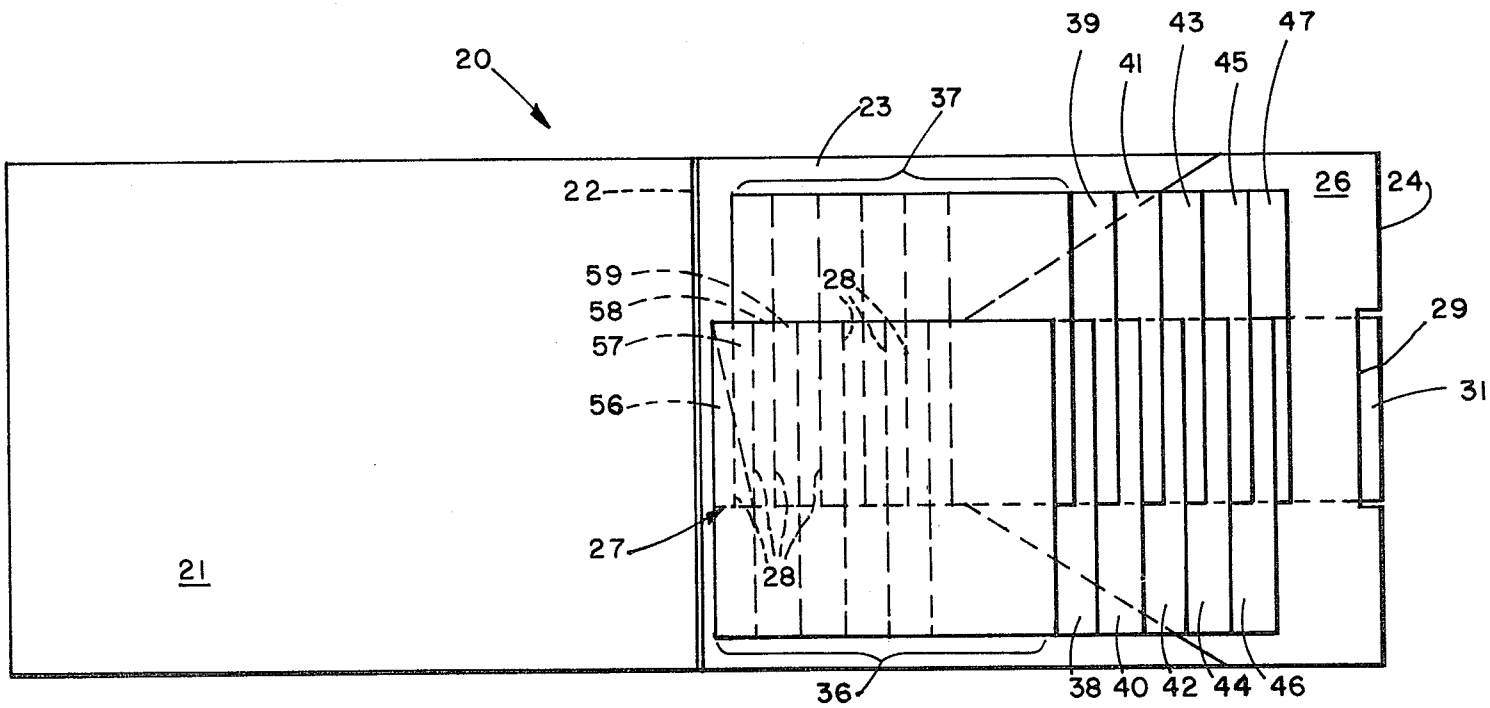
FIG. 3 is an assembled top plan view of the folder of FIG. 1, with twelve staggered pages being shown in their closed condition, and with the draw strip uncurled and fully retracted, ready for curling actuation.
Figure 4A:
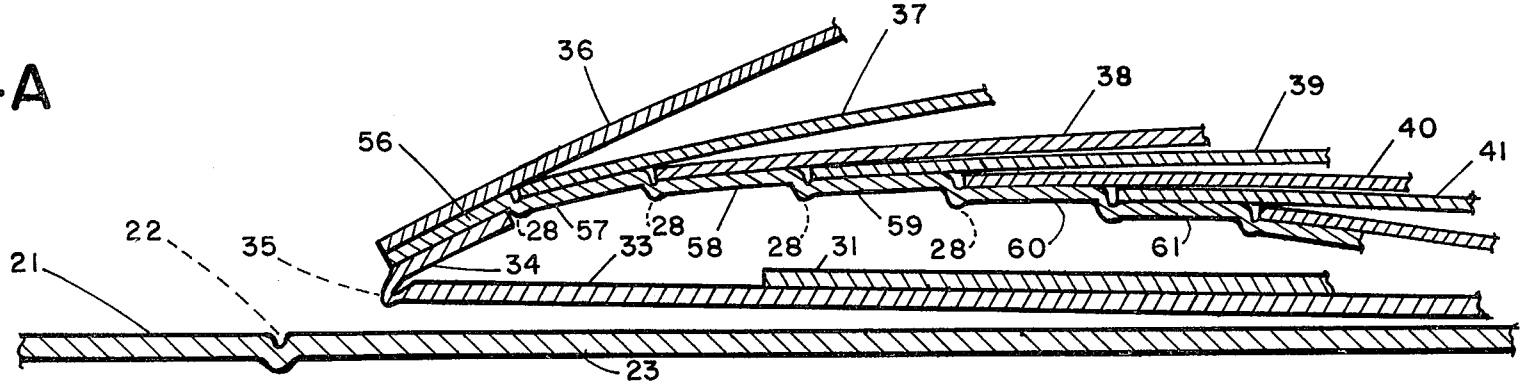
FIG. 4A is a fragmentary enlarged cross-sectional elevation view of the same folder, showing the first few staggered pages glued to the parallel-scored curling drawstrip.
Figure 5:
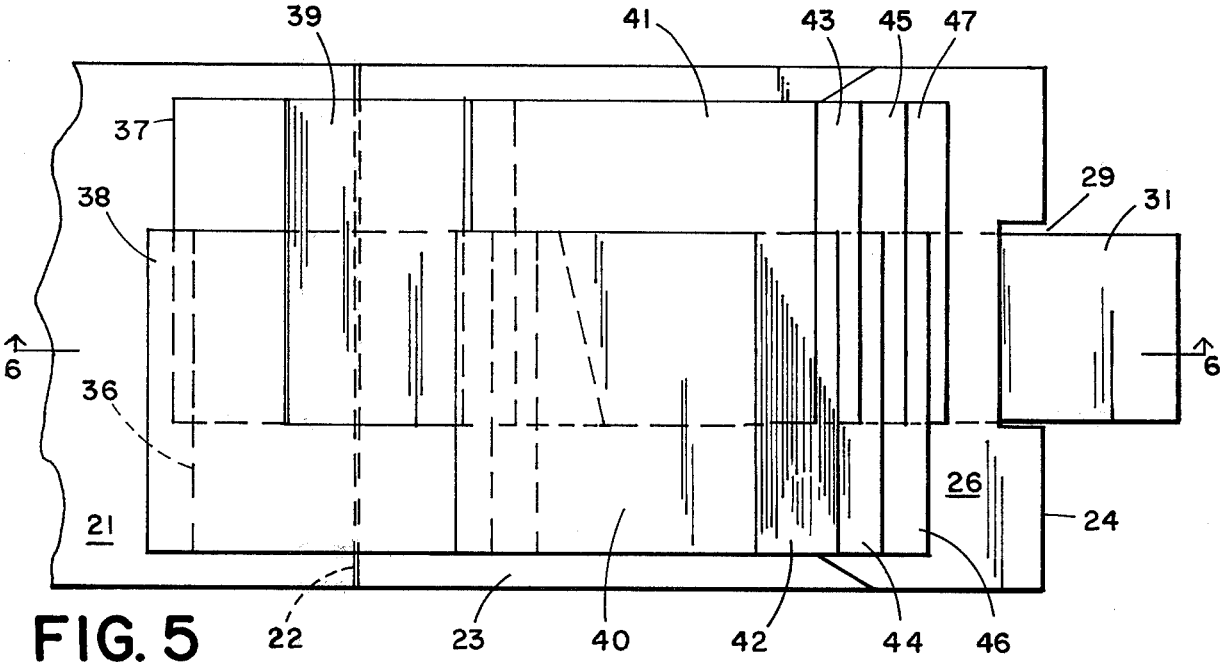
FIG. 5 is a top plan view corresponding to FIG. 3 and showing the draw strip partially extended and three pages already flipped, two more pages in the process of being flipped, and the remaining seven pages closed and ready for flipping actuation.

As best shown in FIGS. 3, 4A and 5, the draw strip 31-33 is formed by folding bottom draw strip panel 33 downward about score line 32 to juxtapose it beneath top draw strip panel 31. These two panels are preferably glued together in this juxtaposed position, with glue zone 34 thus extending beyond the free end of top draw strip panel 31. As indicated in FIG. 1, this double layer draw strip 31-33 is inserted through actuating slot 29, between the back cover 23 and its overlying juxtaposed base panel 26. This insertion brings the glue zone 34 at the far left end of draw strip 31-33 near the score line 22 between back cover 23 and front cover 21. Glue zone 34 is back folded about its score line 35, by which it is hingedly joined to panel 33.

When back panel 26 is folded about score line 24 toward the left in FIG. 2 overlying back cover 23, this brings its parallel scored segmented tab portion 27 extending to the left into close juxtaposition with score line 22 between front cover 21 and back cover 23, as clearly shown in FIG. 3. Directly beneath tab 27 and back panel 26, draw strip 31-33 is inserted into close juxtaposition with tab 27. As shown in FIG. 4A, the reversely folded glue zone 34 at the left end of draw strip 31-33 is juxtaposed with the remote distal segment 56 forming the end of tab 27. These two elongated rectangular areas are glued together, with segment 57 overlying the reversely folded glue zone 34 of draw strip 31-33, when the draw strip is placed in its retracted position as illustrated in FIG. 3, having its right-hand end extending through slot 29 substantially into alignment with score line 24 forming the right-hand edge of back panel 23 into position shown in FIGS. 3 and 4. Also, as shown in these same FIGURES, the upper left-hand corner of the reverse side of page 36 is placed in juxtaposition with the top side of segment 56 of tab 27, and is glued into position thereon, extending cantilever fashion toward the lower edge of back panel 23, and toward the right-hand edge fold line 24 of back panel 23, secured only by its upper left-hand segment.

The next page 37 is similarly superimposed on tab 27, but in this case its lower left corner portion is placed directly above the next segment 57 of tab 27 and is glued into position thereon, extending cantilever fashion toward the upper edge of back panel 23 and the right-hand edge of back panel 23 formed by score line 24. Successive pages 38, 39, 40, etc. are similarly secured to successive segments of tab 27, with their respective upper left or lower left corners being glued successively to segments 58, 59, 60, etc. Thus as clearly shown in FIGS. 1 and 3, the front side of first page 36 overlies a portion of succeeding page 37, leaving a substantial upper portion of page 37 exposed above page 36. Since all succeeding pages are staggered transversely to extend cantilever fashion beyond tab 27 and the central slot 29 through which draw strip 31 extends, the same alternating exposure of a full page and a substantial portion of the next succeeding page is displayed in every case as the pages are flipped open.

Thus, as indicated in FIG. 1, after three pages have been flipped open, the observer finds the reverse side of page 38, the front side of page 39 and substantial portions of the upper part of page 37 and the lower part of page 40 all displayed simultaneously, providing a unique continuity of information displayed during the successive flipping of the folder pages. The operation of the draw strip 31-33 in causing the flip opening operation is best seen in FIGS. 4, 4A, 5, 6 and 7.

Figure 6:
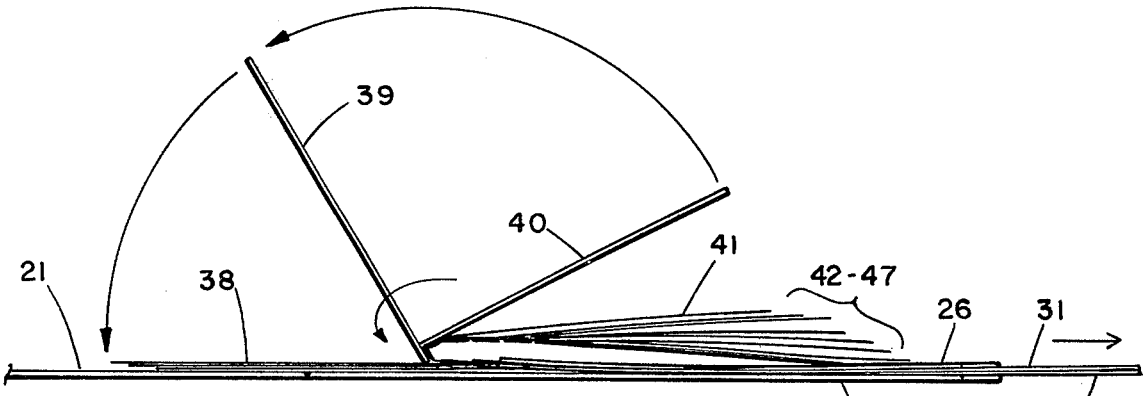
FIG. 6 is a cross-sectional front elevation view corresponding to FIG. 4 showing the same flip-page folder with its drawstrip partially curled, with three pages already flipped and the next two pages in the midst of their flipping, page-turning movement.

As best seen in FIGS. 4, 4A, 6 and 8, tab 27 is formed with parallel score lines 28 dividing it into successive segments 56, 57, 58, 59, etc. Tab 27 is arched upward, and the arching of tab 27 is increased by the user's pull on draw strip 31-33 from left to right, drawing the first segment 56 of tab 27 downward and toward the right in FIGS. 4 and 4A. Continued movement of draw strip 31-33 toward the right causes tab 27 to curl like a breaking wave, with successive score lines 28 forming successive crests at the left end of the curl. This produces successive page-flipping motion, pivoting counterclockwise as shown in FIGS. 1, 6 and 8, and producing successive flipping, opening movement of pages 36–47 one after the other until all of these pages have been flipped over from right to left, to the position shown in FIG. 7, with draw strip 31-33 fully extended to the right. The retracting movement of draw strip 31-33 from right to left uncurls the parallel scored segmented tab 27, reflipping the pages 47–36 successively from left to right, reversing the previous flip-opening operation. During both the opening and the closing successive flipping of these pages, their staggered cantilever arrangement exposes the full faces of two facing pages and substantial portions of the underlying pages.

Figure 4:
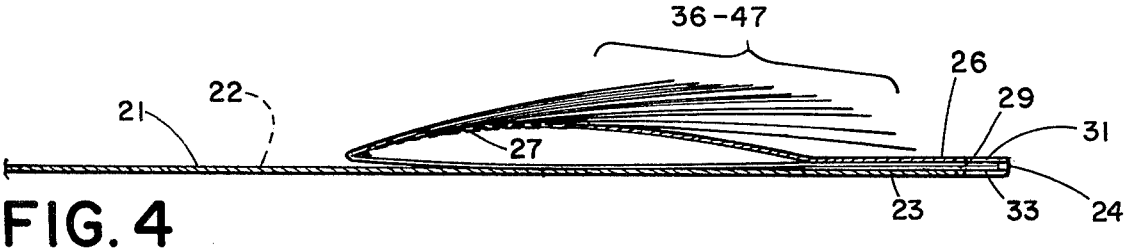
FIG. 4 is a front cross-sectional elevation view of the folder illustrated in FIG. 3, showing all of its twelve pages in their closed positions, ready for actuation.
Figure 7:
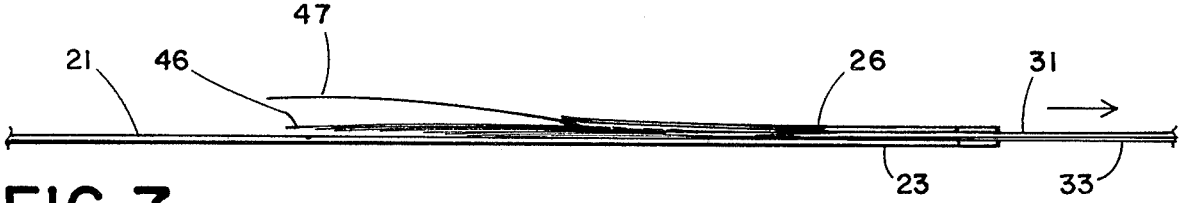
FIG. 7 is a cross-sectional front elevation view of the same flip-page folder, showing all twelve pages flipped and with the draw strip in its fully curled, extended position.

The retraction movement of draw strip 31-33 from right to left, causing the uncurling and flattening of tab 27 from the position shown in FIG. 7 through that of FIG. 6 to the original closed position of FIGS. 4 and 4A, simply reverses the curling, cresting articulation of the parallel-scored tab 27 and returns it to its original slightly arched but virtually flat position indicated in FIG. 4. In this position, cover 21 may be folded from left to right to cover all of pages 36–47 of the entire folder assembly, which is thereby closed ready for storage and reuse whenever desired.

The operations of opening and closing the folders of this invention by drawing draw strip 31-33 from left to right may be interrupted and reversed at any stage allowing the reader to back-track, review, jump forward or turn quickly from any page to any other page in the series with the simple movement of the draw strip 31-33 relative to the folder cover 21-23, while maintaining the same multiple exposure of two facing pages plus substantial portions of underlying pages for maximum continuity of information displayed.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

We claim:

1. A multi-page folder comprising:

a back cover panel bounded by a right fold line, a contiguous base panel joined to the back cover panel at the right fold line, central slot means formed in at least one of said panels near the right fold line joining the back panel and the base panel, a distal segmented tab extending from the base panel away from the right fold line, means forming a plurality of substantially parallel fold lines traversing and subdividing the tab into plural segments, an elongated drawstrip joined to the tab segment remote from the right fold line extending between the back cover panel and the base panel through the central slot means, longitudinally movable from a retracted position substantially flattening the segmented tab to an extended position protruding through the central slot means beyond the right fold line and curling the segmented tab under the base panel toward the slot means, and a plurality of individual separate pages respectively secured to individual segments of the segmetned tab successively oppositely offset laterally in a direction substantially parallel to said parallel fold lines and thus being interleaved in staggered array, whereby progressive movement of the drawstrip from its retracted position towards its extended position causes progressive curling movement of the segmented tab, successively flipping over the individual staggered interleaved pages, while at all times displaying to view at least one full page and a substantial area of an underlying staggered page, thereby changing only part of the indicia displayed during each successive stage of the page-flipping operation.

2. The multi-page folder defined in claim 1, further including a contiguous cover panel joined to the back cover panel at a second fold line not coinciding with the right fold line.

3. The multi-page folder defined in claim 1, wherein each underlying page extends in staggered relationship beyond the overlapping edge of the overlying page to display substantially one-half of the area of the underlying page when the overlying page is exposed to view.

4. The multi-page folder defined in claim 1 including means forming a recessed notch extending inward in the back cover panel and base panel providing a gripping zone within which the exposed end of the drawstrip can be seized by the user when in its retracted position.

5. The multi-page folder defined in claim 4 wherein the recessed notch forms the central slot means.

6. The multi-page folder defined in claim 1 wherein the central slot means subdivides the right fold line into separated portions.

* * * * *